United States Patent [19]

Theurer

[11] 4,393,784

[45] Jul. 19, 1983

[54] APPARATUS FOR REPLACING RAIL FASTENING ELEMENTS AND, OPTIONALLY, RAILS

[75] Inventor: Josef Theurer, Vienna, Austria

[73] Assignee: Franz Plasser Bahnbaumaschinen-Industriegesellschaft m.b.H., Vienna, Austria

[21] Appl. No.: 332,303

[22] Filed: Dec. 18, 1981

Related U.S. Application Data

[63] Continuation of Ser. No. 149,159, May 14, 1980, abandoned, which is a continuation of Ser. No. 902,853, May 4, 1978, abandoned.

[30] Foreign Application Priority Data

May 6, 1977 [AT] Austria ..... 3255/77

[51] Int. Cl.[3] ..... E01B 29/20; E01B 31/26; E01B 31/22

[52] U.S. Cl. ..... 104/2; 104/16; 104/17 R

[58] Field of Search ..... 104/1 R, 2, 4, 5, 6, 104/7 R, 7 B, 12, 16, 17 R, 17 A; 29/428, 429

[56] References Cited

U.S. PATENT DOCUMENTS

| | | | |
|---|---|---|---|
| 1,941,930 | 1/1934 | Collet et al. | 104/5 |
| 3,257,962 | 6/1966 | Doorley et al. | 104/17 R |
| 3,286,648 | 11/1966 | Brosnan | 104/2 |
| 3,469,534 | 9/1969 | Plasser et al. | 104/7 B |
| 3,595,170 | 7/1971 | Plasser et al. | 104/12 |
| 3,690,264 | 9/1972 | Plasser et al. | 104/17 R |
| 4,046,078 | 9/1977 | Theurer | 104/7 R |
| 4,068,596 | 1/1978 | Theurer | 104/12 |

FOREIGN PATENT DOCUMENTS

| | | | |
|---|---|---|---|
| 244376 | 1/1966 | Austria | 104/2 |
| 2129180 | 1/1972 | Fed. Rep. of Germany | 104/2 |
| 2550819 | 6/1976 | Fed. Rep. of Germany | 104/2 |
| 2298645 | 8/1976 | France | 104/2 |
| 420718 | 8/1974 | U.S.S.R. | 104/17 A |

OTHER PUBLICATIONS

"Automated Rail Change Out for Conventional Track", *Railway Track and Structures*, Aug. 1979, pp. 40, 41, 44.

*Primary Examiner*—Randolph Reese
*Attorney, Agent, or Firm*—Kurt Kelman

[57] ABSTRACT

Track rails fixed to ties with old rail fasteners are replaced by track rails fixed to the ties with new rail fasteners at gauge with an assembly line of a series of individual operating mechanisms arranged spacedly and sequentially on a train of a plurality of track-bound cars and including a carrier frame. Each operating mechanism includes vertically movable tools centered over their work and the assembly line comprises, in sequence, a first operating mechanism mounted on the carrier frame for lifting the rails at gauge and for spreading the lifted rails beyond the track gauge after the old rail fasteners have been detached from the ties, the detached rail fasteners leaving holes in the ties, an operating mechanism for plugging the holes in the ties and an operating mechanism for adzing the ties mounted on the carrier frame, an additional operating mechanism mounted on the carrier frame for placing the track rails on the plugged and adzed ties at the gauge, and a further operating mechanism for applying the new rail fasteners to fix the track rails to the plugged and adzed ties.

7 Claims, 3 Drawing Figures

APPARATUS FOR REPLACING RAIL FASTENING ELEMENTS AND, OPTIONALLY, RAILS

Figure 1:
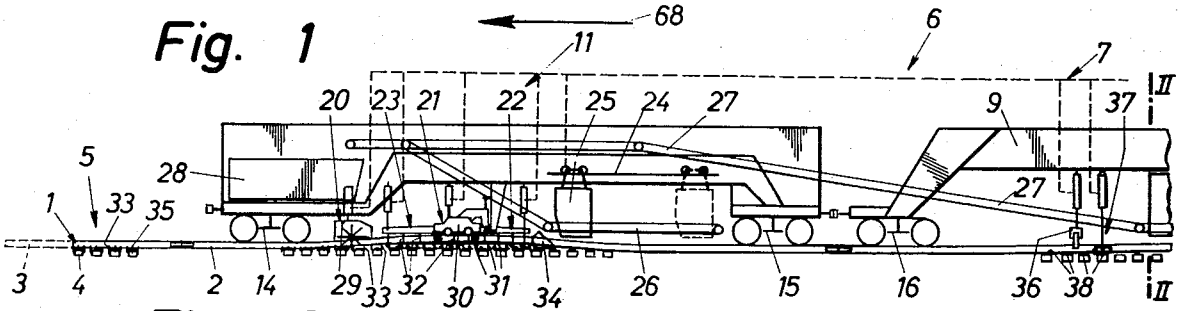

This application is a continuation of copending application Ser. No. 149,159, filed May 14, 1980, which is a continuation of copending application Ser. No. 902,853, filed May 4, 1978, both of which are abandoned.

The present invention relates to an apparatus for replacing track rails fixed to ties with old rail fastening elements at a predetermined track gauge by track rails fixed to the ties with new rail fastening elements at this gauge.

U.S. Pat. No. 3,286,648, dated Nov. 22, 1966, discloses the replacement of old rails by new rails with a plurality of individual operating mechanisms running on the track rails independently of each other for independent operation. Such independently operating mechanisms may include, for example, a machine for assembling and disassembling tie plates, such as shown in U.S. Pat. No. 3,690,264, dated Sept. 12, 1972, or such machines as disclosed in Published German patent application No. 2,550,819 or Austrian Pat. No. 244,376. With these machines it is possible to detach the rail fastening elements, to lift the old rails from the ties, to prepare the ties for receiving the new rail fastening elements, to replace the rails and to fix them to the ties with the new rail fastening elements. The ties themselves are not replaced. Such machines have become known as a "rail gang". Since a plurality of independent machines are used in the operation, a large number of operating personnel is needed and the track-bound machines require different wheel gauges to be able to operate in the area of the spread rails. The start and termination of the operation is very time-consuming, the operation itself is discontinuous, and the quality of the work leaves much to be desired. Track renewal trains for replacing an entire old track, including ties, rail fasteners and rails, by a new track are also well known, one such apparatus being disclosed, for example, in Published German patent application No. 2,129,180, published Jan. 20, 1972.

It is the primary object of this invention to provide an apparatus of the first-indicated type which replaces the track rails on existing and remaining ties in a continuous assembly line operation at higher operating speeds and improved track quality than heretofore obtainable.

This and other objects are accomplished in accordance with the invention with a train of a plurality of track-bound cars mounted for mobility along the track rails in an operating direction and including a carrier frame, and an assembly line of a series of individual operating mechanisms arranged spacedly and sequentially on the train, each of the operating mechanisms including vertically movable tools centered over their work. The assembly line comprises a first individual operating mechanism mounted on the carrier frame for lifting the rails at gauge and for spreading the lifted rails beyond the track gauge after the old rail fastening elements have been detached from the ties, the detached rail fastening elements leaving holes in the ties, means for working on the ties mounted on the carrier frame, the tie working means including an operating mechanism for plugging the holes in the ties and an operating mechanism for adzing the ties, an additional individual operating mechanism mounted on the carrier frame for placing the track rails on the plugged and adzed ties at the gauge, and a further individual operating mechanism for applying the new rail fastening elements to fix the track rails to the plugged and adzed ties. The carrier frame may be track-bound and it may be preceded and followed by a respective track-bound car.

By providing what appears at first sight a relatively simple expedient of a carrier frame as part of a train for an assembly line of a series of individual operating mechanisms, I have unexpectedly and for the first time obtained a continuous assembly line handling of the rail fastening elements and working on the ties, without replacing the rail support, with a single mobile apparatus forming a train of track-bound cars operating at a high efficiency. This assembly line increases the speed of the operation primarily because of the timed sequence of the individual operating stages while also enhancing the accuracy of the entire work. In addition, the rail fastening elements and the rails are carefully handled by the individual operating mechanisms, which increases their operating life, the rails being guided in the range of the ties which are re-surfaced within permitted tolerances of deformation. Furthermore, the tools of the operating mechanisms are properly centered by the central arrangement of the carrier frame forming part of the train. If driven and operated from a central source of power and central control panel, the structure as well as the servicing of the apparatus is greatly simplified.

Figure 2:
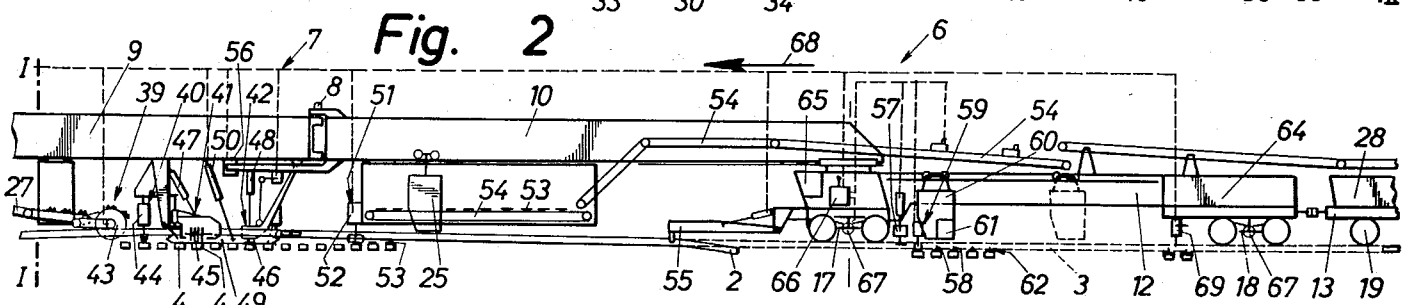
Figure 3:
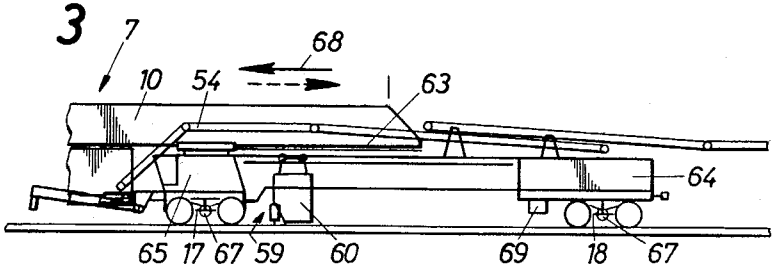

The above and other objects, advantages and features of this invention will become more apparent from the following detailed description of a now preferred embodiment thereof, taken in conjunction with the accompanying schematic drawing wherein FIG. 1 is a simplified side elevational view of the forward portion of the apparatus, FIG. 2 is a continuation of the apparatus of FIG. 1, showing a rear portion thereof, line I—I in FIG. 2 indicating where the apparatus continues at line II—II of FIG. 1, and FIG. 3 is a like side elevational view of a portion of the rear frame part of the common carrier frame shown in FIG. 2, with the undercarriage in transport position.

Referring now to the drawing, there is shown an apparatus for replacing old track rails 2 fixed to ties 4 of track 5 with old rail fastening elements 1 at a predetermined track gauge by new track rails 3 fixed to the ties with new rail fastening elements 62 at this gauge. If desired, no new rails need be used and the old rails could be re-laid after the ties have been re-surfaced and only the rail fastening elements have been replaced.

The apparatus comprises train 6 of a plurality track-bound cars 11, 12, 13 mounted for mobility along track 5 in an operating direction indicated by arrow 68 and including carrier frame 7 in the illustrated embodiment, the carrier frame is track-bound, too, having undercarriages 16, 17 supporting the carrier frame on the track rails. Track-bound car 11 precedes forward frame part 9 of carrier frame 7 and includes a first carrier frame which is supported on the track by undercarriages 14, 15. Track-bound cars 12 and 13 succeed rear frame part 10 of carrier frame 7 and are supported on the track by undercarriages 18 and 19, respectively.

In the illustrated embodiment, an assembly line of a series of individual operating mechanisms 20, 21, 22, 23 are arranged on the first carrier frame of track-bound car 11. An operator's cab 25 is mounted on the first carrier frame for movement along guide track 24 in relation to the first carrier frame so as to be movable from a remote position (shown in broken lines) to a position (shown in full lines) adjacent a respective one of the operating mechanisms. First conveyor means including endless conveyors 26 and 27 is mounted on car 11 for removing the detached rail fastening elements 1 to a storage bin 28 on car 11.

Operating mechanisms 20 to 23 are constituted, in sequence, by rotary broom 29, mechanism 30 for lifting rails 2 at gauge and for laying them at gauge, a series of sequentially arranged tools 31 operable simultaneously for pulling spikes and tools 32 for detaching rail anchors 33. A schematically indicated device 34 for holding the ties in position is associated with this first group of operating mechanisms to avoid raising the ties off the ballast bed on which they rest, particularly while the spikes are detached and pulled. These operations could be effected in a preceding stage and the corresponding operating mechanisms need not be mounted on a car coupled to carrier frame 7 but may be on apparatus running ahead of the train incorporating carrier frame 7.

Carrier frame 7 comprises two pivotal frame parts 9 and 10 and pivoting axle 8 extending substantially perpendicularly to a plane defined by the track rails interconnects the pivotal frame parts for pivotal movement with respect to each other so as to permit the elongated carrier frame to move properly in track curves. Drive and locking mechanism 56 connects the two pivotal frame parts for imparting pivotal movement thereto and for locking the two frame parts at a selected pivotal position. As shown in FIG. 1, operating mechanism 36 for lifting the rails at gauge and for spreading the lifted track rails either during removal of the old rails or laying of new rails, and tool 37 for detaching the old tie plates 38 are arranged on the forward frame part. This forward frame part 9, as illustrated in FIG. 2, also mounts individual operating mechanisms 39, 40, 41, 42. These operating mechanisms are constituted, in sequence, by a magnetic device 43 for removing the detached rail fastening elements 1 from the ballast bed and the ties and to convey them to conveyor 27, plugging tool 44 for driving plugs into the holes in ties 4 left therein by the detached spikes or for driving broken spikes into the ties, a crib cleaner 45 for removing ballast from the cribs defined between adjacent ties 4 to a level below the upper edge of the ties at least in the regions of the ties where the rails rest thereon, and adzing device 46 for adzing these tie regions until the upper faces thereof define substantially a common plane.

Ballast removing device 45 preferably is a double-crib cleaner comprising an axle extending in the direction of the carrier frame and track rails and carrying ballast cleaning elements, such as rubber hoses, with which the ballast at each longitudinal edge of the tie between two cribs is displaced from the region of tie 4 whereon the rails come to rest in the assembled track structure. The rubber hoses tend to sweep or force the ballast in the direction of the track shoulders when the axle is rotated. The crib cleaner is operated until the ballast to a depth of at least about 10 cm from the upper surface of ties 4 has been removed. The vertical adjustment of the rotating axle carrying the rubber hoses is obtained by hydraulic drives 47.

Adzing device 46 has a milling head for working on the surfaces of ties 4 whereon the rails come to rest, i.e. which receive the tie plates, the milling head being vertically adjusted by hydraulic drive 48. During the ballast removing and tie working operations, tie 4 is held in place by tie holding device 49, and the vertical adjustment of the milling head may be controlled by a measuring device which determines the vertical distance of the milling head with respect to frame part 9 or tie holding device 49 which, in turn, may be vertically adjusted by hydraulic drive 50. It will be useful to mount in the region of the adzing device, and associated therewith, a creosoter for applying a tie conserving medium to the adzed tie surface.

Rear pivotal frame part 10 mounts additional individual operating mechanism 55 for placing the track rails on ties 4 at gauge. The assembly line on the train includes a further individual operating mechanism 51 including tool 52 for applying the new rail fastening elements to fix the track rails to the plugged and adzed ties. The latter operating mechanism 51 constituted by a tool 52 for mounting new tie plates 53 is mounted on rear frame part 10 in the illustrated embodiment. Operator's cab 25 is mounted on frame part 10 for movement along the frame part and along a conveyor 54 for moving new tie plates 53 to tool 52. A support frame mounts the rear end of frame part 10 on undercarriage 17 of track-bound car 12.

The preferred embodiment herein illustrated and described hereinabove makes it possible to provide a relatively long railless section for working on the ties while, at the same time, assuring excellent adaptation of the assembly for movement in track curves and centering of the tools of all the operating mechanisms over their work. At the same time, the track renewal section is compact so that the work may be interrupted without great losses in time and efficiency to permit train traffic to pass from time to time, either on the track on which work is done or on a parallel track. With the use of first carrier frame 11 preceding carrier frame 7, the removal of certain rail fastening elements may be effected in advance so that the number of the operating mechanisms in the railless section may be held to a minimum, thus minimizing its length. Using the movable operator's cabs in conjunction with the various operating mechanisms makes a highly automated replacement operation possible. Since the operators are located in cabs on the assembly itself, the personnel is not subjected to danger from passing trains and, at the same time, they are in a good position for controlling the entire operation and enhancing its accuracy.

Gauge holding or fixing device 57 is mounted on rear car 12 for holding the newly laid track rails at gauge while the tools of operating mechanism 59 are operated to drive new spikes 58 into the ties for fastening the rails thereon. Another longitudinally adjustable operator's cab 60 is mounted on car 12 in the region of device 57 and mechanism 59 to enable the same to be operated.

Second conveyor means constituted by elongated conveyor 54 transports the new rail fastening elements to the second group of operating mechanisms, including new tie plates 53 to cab 25 and new spikes 58 to operating mechanism 59. The new fastening elements 62 are stored in storage bin 28 on track-bound car 13 forming part of the assembly, and suitable baffles may be mounted on conveyor 54 to guide the new spikes into a storage container 61 in cab 60 while the new tie plates 53 continue on conveyor 54 to mechanism 52.

As is shown in FIG. 3, track-bound car 12 is movable with its support along guide track 63 on frame part 10 towards and away from pivoting axle 8. In this manner, the wheel base may be changed while the assembly is driven from working site to working site, which improves the running characteristics of elongated two-part carrier frame 7, particularly in track curves.

Car 12 supports a central source of power 64, for instance a hydraulic fluid sump, and operating drives 47, 48, 50 as well as all the vertically movable tools of the individual operating mechanisms are connected to the central power source for operating the same from this source, the control circuit connecting the drives and tools to the source as well as to control panel 66 at central operator's cab 65 being shown in broken lines. Furthermore, a motor means 67 constituted by motors driving the wheels of undercarriages 17, 18 is also connected to central power source 64 for operation thereby to move the train of track-bound cars along the track rails, thus providing a self-propelled unit.

This central power source and control simplifies the entire arrangement and enables the operating steps to proceed in a planned and readily controllable manner.

The apparatus described hereinabove may be advantageously used in the following method of replacing track rails fixed to ties with old rail fastening elements including rail anchors, spikes and tie plates at a predetermined gauge by track rails fixed to the ties with new rail fastening elements including rail anchors, spikes and tie plates at this gauge:

When train 6 has arrived at the working site, the tools of the individual operating mechanisms are lowered into operating position and a continuous assembly line operation of the following sequential steps is effectuated as the train advances in the operating direction indicated by arrow 68 at slow speed. In front, rotary broom 29 cleans the surfaces of ties 4 so as to remove any ballast therefrom and provide free access to old rail fastening elements 1. Tools 32 are operated to detach old rail anchors 33, rails 2 connected by fish-plates are lifted at gauge by device 30 and old spikes 35 are detached with spike pullers 31. In front of undercarriage 15, old rails 2 are placed on the tie plates, ties 4 being held in place by holding device 34 while the rail anchors and the spikes are detached so as to avoid lifting the ties out of the ballast bed.

At the front of forward frame part 9 of carrier frame 7, old track rails 2, together with new track rails 3, which have previously been stored on the ties between the old rails and which may consist of lengths of rails of about 120 m, are lifted and spread beyond the track gauge whereby the rails are guided in a spread condition to leave a railless track section. In this railless section, old tie plates 38 are detached by mechanism 37. The old and detached rail fastening elements 1, such as rail anchors 33, spikes 35 and tie plates 38, which lie on the ballast, are picked up by magnetic drum 43 moving them to conveyor 27 which transports these elements to storage bin 28 on car 11. Thereupon, plugs are driven into the holes left in the ties by the detached spikes by plugging tool 44 and, if desired, broken remainders of spikes are also driven into the ties. The ballast is now removed from the cribs defined between adjacent ties 4 to a level below an upper edge of the ties at least in the regions of the ties where the rails rest thereon, by use of crib cleaners 45. During this operation, the ties are held in place by holding device 49 and, while so held, the milling heads of adzing device 46 removes the weathered surfaces of ties 4, the above-indicated regions of the ties being adzed until the upper faces thereof define substantially a common plane to provide a smooth support ribbon on the ties for new tie plates 53. These tie plates are moved to mechanism 51 by conveyor 54 and are fixed to the ties by screws or nails, whereupon new track rails 3 are laid at gauge on the new tie plates by device 55.

The newly laid track rails are held at gauge by gauge fixing device 57 mounted on track-bound car 12 and new spikes 58 are applied thereto by mechanism 59 to fix the rails on the ties. As schematically shown, additional operating mechanism 69 may be provided for applying rail anchors at both sides of ties 4.

In this assembly line operation, old rails and their fastening elements are replaced by new rails with their new fastening elements while the ties remain in place in the ballast bed. Of course, if the old rails themselves are in good condition, it is possible to reuse them, instead of new rails, and to replace only the rail fastening elements.

It may be advantageous to arrange the individual operating mechanisms 20–23, 37, 39–42, 51 and 59 on guides extending in the longitudinal direction of the carrier frame and to provide drives for these mechanisms for moving them along the guides for adjusting their position on the assembly. It is possible to control the speed of the displacement of the operating mechanisms as well as the operator's cab automatically in relation to the forward speed of train 6 by suitably programming control panel 66.

The structure of the various operating mechanisms and their drives may vary widely, as will be obvious to those skilled in the art, and the power may be pneumatic or mechanical instead of hydraulic, as described and illustrated. A great variety of mechanisms for detaching and assembling rail fastening elements are well known.

What is claimed is:

1. An apparatus for replacing track rails fixed to ties with old rail fastening elements at a predetermined track gauge by track rails fixed to the ties with new rail fastening elements at said gauge, which comprises (a) a train of a plurality of track-bound cars mounted for mobility along the track rails at said gauge in an operating direction and one of the cars being a carrier frame comprising
  (1) two pivotal frame parts and
  (2) a pivoting axle extending substantially perpendicularly to a plane defined by the track rails and interconnecting the pivotal frame parts for pivotal movement with respect to each other, (b) an assembly line of a series of individual operating mechanisms arranged spacedly and sequentially on the track-bound cars, each of the operating mechanisms including vertically movable tools mounted on the cars and centered over their work, the assembly line comprising, in sequence,
  (1) a first one of the individual operating mechanisms including tools for detaching the old rail fastening elements from the ties, the removed rail fastening elements leaving holes in the ties,
  (2) another one of the individual operating mechanisms for lifting the rails at gauge and for spreading the lifted rails beyond the track gauge, the first and other operating mechanisms being arranged on a forward one of the frame parts, as seen in the operating direction,
  (3) means for working on the ties mounted on the carrier frame, the tie working means including an operating mechanism for plugging the holes in the ties and an operating mechanism for adzing the ties, (4) an additional one of the individual operating mechanisms for placing the track rails on the plugged and adzed ties at said gauge, (5) a further one of the individual operating mechanisms including tools for applying the new rail fastening elements to fix the track rails to the plugged and adzed ties, the additional and further operating mechanisms being arranged on a rear one of the frame parts, as seen in the operating direction, and (6) respective tie holding devices associated with the tie working means and the first operating mechanism.

2. The apparatus of claim 1, wherein the carrier frame is preceded and followed by a respective one of the track-bound cars, in the operating direction.

3. The apparatus of claim 2, wherein the first one of the individual operating mechanisms is mounted on the track-bound car preceding the carrier frame.

4. The apparatus of claim 1, wherein the rail fastening elements include tie plates, further comprising means mounted on the carrier frame for removing the old tie plates, the tie plate removing means preceding the hole plugging mechanism, and means mounted on the carrier frame for placing the new tie plates on the ties, the tie plate placing means following the tie adzing mechanism.

5. The apparatus of claim 1, wherein one of the track-bound cars precedes the forward frame part in said direction and includes a first carrier frame, the individual operating mechanisms for detecting the old rail fastening elements and the operating mechanism for lifting the rails at gauge being arranged on the first carrier frame.

6. The apparatus of claim 1, further comprising at least one operator's cab mounted on at least one of the carrier frames for movement in relation thereto in said direction, each of the operator's cabs being movable adjacent to a respective one of the operating mechanisms, first conveyor means for removing the detached old rail fastening elements, a second conveyor means for transporting the new rail fastening elements to the further operating mechanism, and storage bins associated with the conveyor means for storing the old rail fastening elements received from the first conveyor means and the new rail fastening elements transported by the second conveyor means.

7. The apparatus of claim 1, wherein the carrier frame further comprises a drive and locking means for imparting the pivotal movement and for locking the two pivotal frame parts at a selected pivotal position.

* * * * *